US011235451B2

(12) United States Patent
Bombulie

(10) Patent No.: US 11,235,451 B2
(45) Date of Patent: Feb. 1, 2022

(54) STAPLE DEVICE WITH EXTENSION ROD

(71) Applicant: Michael Allen Bombulie, Broomfield, CO (US)

(72) Inventor: Michael Allen Bombulie, Broomfield, CO (US)

( * ) Notice: Subject to any disclaimer, the term of this patent is extended or adjusted under 35 U.S.C. 154(b) by 84 days.

(21) Appl. No.: 16/428,991

(22) Filed: Jun. 1, 2019

(65) Prior Publication Data

US 2019/0366528 A1 Dec. 5, 2019

Related U.S. Application Data

(60) Provisional application No. 62/679,813, filed on Jun. 2, 2018.

(51) Int. Cl.

| | |
|---|---|
| ***B25C 7/00*** | (2006.01) |
| ***B25C 5/11*** | (2006.01) |
| ***B25C 5/06*** | (2006.01) |
| *F21W 121/00* | (2006.01) |
| *F21S 4/20* | (2016.01) |

(52) U.S. Cl.

CPC ..... *B25C 7/00* (2013.01); *B25C 5/06* (2013.01); *B25C 5/11* (2013.01); *F21S 4/20* (2016.01); *F21W 2121/004* (2013.01)

(58) Field of Classification Search

CPC .... B25C 7/00; B25C 1/00; B25C 1/02; B25C 1/04; B25C 5/06; B25C 5/0292; B25C 5/11

USPC ..... 227/5, 7, 8, 9, 30, 111, 120, 129, 132, 227/156

See application file for complete search history.

(56) References Cited

U.S. PATENT DOCUMENTS 1,186,458 A * 6/1916 Von Vass ..... B25C 5/11 227/129
1,441,474 A * 1/1923 Anderson ..... B25C 5/06 227/127
3,291,356 A * 12/1966 Armstrong ..... B25H 1/0035 227/82
3,310,215 A * 3/1967 Bostick ..... B25C 5/06 227/111

(Continued)

FOREIGN PATENT DOCUMENTS

JP 3117765 1/2006

OTHER PUBLICATIONS

Watts Radiant, Inc., Staple Gun Extension Arm, Jan. 1, 2003.

*Primary Examiner* — Valentin Neacsu
*Assistant Examiner* — Jacob A Smith
(74) *Attorney, Agent, or Firm* — Stanley J. Gradisar Attorney At Law, LLC; Stanley J. Gradisar

(57) ABSTRACT

A staple device with an extension rod allows an installer to use the device to hold and pull tension on a string of wired lights and secure them to a surface, such as the underside of eaves or soffits on a dwelling. The activation of the stapling device is achieved by a pushing motion against the surface to be stapled to rather than the squeezing motion of current stapling devices. The staple device also provides greater mobility to the installer as opposed to the current method of positioning and repositioning a ladder around the base of the dwelling. The present invention allows the installer to quickly traverse the base of the dwelling and install the holiday lights in a more efficient manner than with the use of a ladder and squeeze-type staple staplers.

15 Claims, 4 Drawing Sheets

(56) References Cited

U.S. PATENT DOCUMENTS 4,284,223 A * 8/1981 Salcido ..... B25C 7/00 227/132
4,627,563 A * 12/1986 Meyer ..... A01G 13/0293 227/120
5,038,665 A * 8/1991 Aske ..... B25C 1/082 89/1.14
5,042,142 A * 8/1991 Beach ..... E04D 3/3603 29/787
5,163,597 A * 11/1992 Napoli, Jr. ..... B25C 3/006 227/140
5,509,489 A * 4/1996 Lower, Jr. ..... B21J 15/38 173/170
6,467,823 B1 * 10/2002 Brekken ..... F21V 19/04 29/241
6,968,989 B1 * 11/2005 Hall, Jr. ..... B25C 1/02 173/90
7,228,917 B2 6/2007 Matthew et al.
7,237,707 B1 7/2007 Wakelin
7,258,261 B1 * 8/2007 Reyes ..... B25C 7/00 173/170
7,506,788 B2 * 3/2009 Liang ..... B25C 1/06 227/129
7,552,852 B2 * 6/2009 Haskins ..... B25C 1/02 227/113
8,152,040 B2 * 4/2012 Hamman ..... E02D 17/20 227/140
8,292,281 B1 * 10/2012 Smith ..... B25C 3/008 269/287
8,381,959 B1 * 2/2013 Comerford ..... B25G 3/24 227/110
2006/0062680 A1 * 3/2006 Myrowich ..... B25C 5/161 417/554
2006/0162942 A1 7/2006 Martin
2007/0045376 A1 3/2007 Gaudron
2008/0017690 A1 * 1/2008 Galitsky ..... B25C 5/06 227/154
2010/0038399 A1 * 2/2010 Martinez ..... B25C 7/00 227/110
2012/0145764 A1 * 6/2012 Fiorini ..... B25C 7/00 227/147

* cited by examiner

STAPLE DEVICE WITH EXTENSION ROD

CROSS-REFERENCES TO RELATED APPLICATIONS

This application claims the benefit of U.S. Provisional Application Ser. No. 62/679,813 filed on Jun. 2, 2018 titled "STAPLE FASTENING DEVICE WITH EXTENSION ROD" which is incorporated herein by reference in its entirety for all that is taught and disclosed therein.

FIELD OF THE INVENTION

The invention pertains to hand tools. More specifically, the invention pertains to a stapling device for hanging a strand of wired lights.

BACKGROUND OF THE INVENTION

During holiday seasons, holiday lights are often hung on the exterior of residential dwellings. More specifically the holiday lights are often secured to the underside of the eaves or soffits of the dwelling. The holiday lights are often secured to the soffit by means of a stapling device such as a staple gun. As soffits of most dwellings are at an elevated position, the installer must often use some person elevating device, such as a ladder. This can present several problems.

First the ground near the side of residential dwellings is often uneven or lined with shrubbery. This makes placement of a ladder difficult and often times unsafe for the installer. Second, holiday lights are often installed during holiday seasons which occur during the cold winter months. Using a ladder on uneven ground during icy or snowing conditions can prove unsafe and dangerous to the installer as well. Third, for multiple story residential dwellings, often times a free-standing ladder will not reach the soffit and an extension ladder must be used. An extension ladder is rested against the exterior finish of the dwelling and can often damage softer exterior finishes such as stucco. Extension ladders are often both unsafe and damaging when placed on false exterior accents such as stucco coated foam entry pillars. Finally, a ladder provides a limited span for which the installer can secure the holiday lights to the soffit before he or she needs to reposition the ladder. Over extension on a ladder to achieve a greater span to install the holiday lights is dangerous and unsafe.

For these reasons listed above falls from ladders are often common occurrences for installers. While ladder falls can be dangerous for any population, injuries resulting from ladder falls are often more severe for the elderly population. These injuries can lead residential dwelling owners to forgo installing holiday lights or hire expensive contractors to install the holiday lights. This invention is a device which allows for the installation of holiday lights by an installer without the use of a person elevating device. The installer can safely and quickly walk around the exterior of the residential dwelling and install the holiday lights without the use of a ladder or the need of an expensive contractor.

SUMMARY OF THE INVENTION

The present invention allows an installer to use the device to hold and pull tension on a string of holiday lights and secure them to the underside of a soffit on a dwelling. The activation of the stapling device is achieved by a pushing motion against the surface to be stapled to rather than the squeezing motion of current stapling devices. The staple device also provides greater mobility to the installer as opposed to the current method of positioning and repositioning a ladder around the base of the dwelling. The present invention allows the installer to quickly traverse the base of the dwelling and install the holiday lights in a more efficient manor than with the use of a ladder and squeeze-type staple gun

Figure 1:
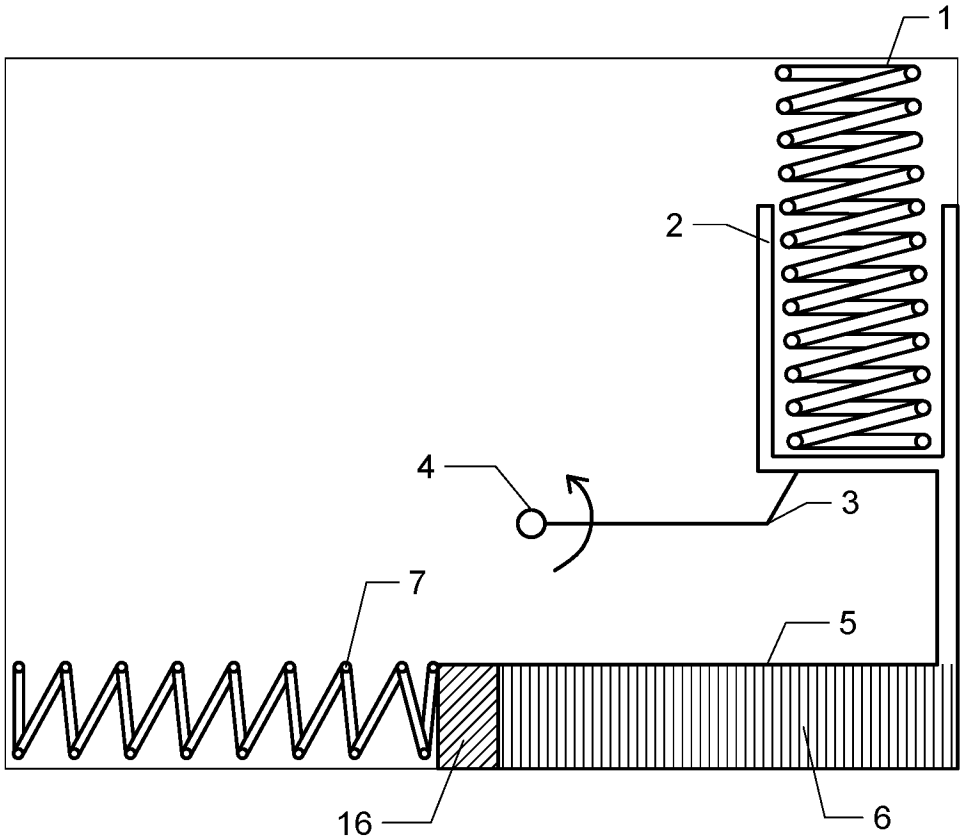
FIG. 1 shows an internal view of an embodiment of the anvil spring, anvil actuator arm, staple tension spring, staple holder, staple sled, staple anvil, rotation axle, and staples in an embodiment of the present invention.

To assist in the understanding of the present disclosure the following list of components and associated numbering found in the drawings is provided herein:

Table of Components

| Component | # |
|---|---|
| anvil spring | 1 |
| staple anvil | 2 |
| anvil activator arm | 3 |
| rotation axle | 4 |
| staple holder | 5 |
| staples | 6 |
| staple tension spring | 7 |
| extension rod shoe | 8 |
| staple device | 9 |
| rotation gear | 10 |
| rotation gear bearing | 11 |
| rotation gear teeth | 12 |
| rack gear | 13 |
| tension and activation component | 14 |
| groove | 15 |
| staple sled | 16 |
| surface | 17 |
| extension rod | 18 |
| wired lights | 19 |
| installer | 20 |

DETAILED DESCRIPTION

Referring now to FIG. 6, the staple device 9 is attached to an extension rod 18. The staple device 9 in conjunction with the extension rod 18 is used to hang strands of wired lights 19, such as Christmas lights, Halloween lights, or other decorative strands of wired lights, to a surface 17, such as the eaves or soffit of a house. The extension rod 18 would allow for a ground-based installer 20 to reach the surface 17 without the use of a ladder. The staple device 9 would allow the installer 20 to quickly move around the base of the house and install the wired lights 19 faster than utilizing a ladder. The staple device 9 is similar to a common staple gun with significant operational modifications.

Figure 2:
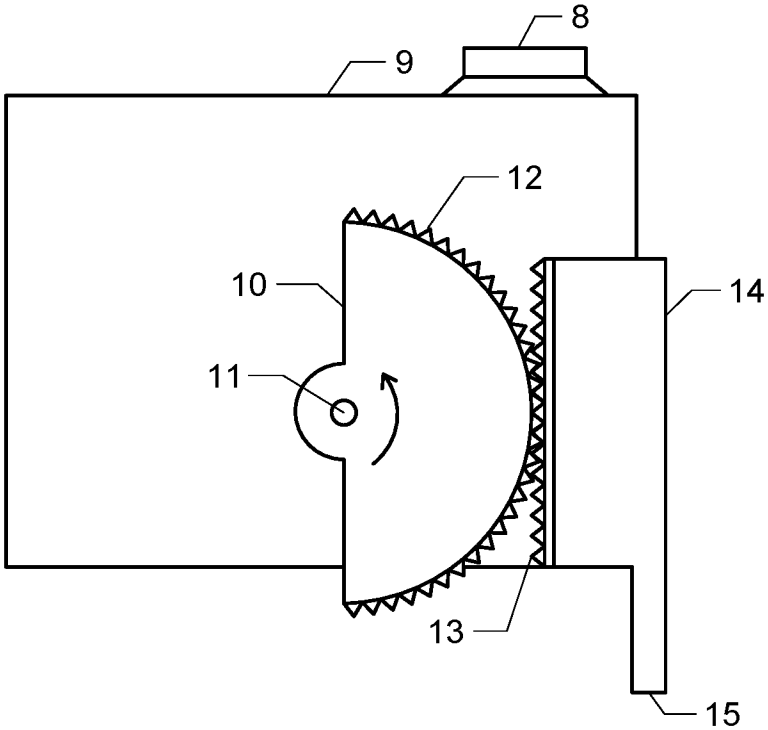
FIG. 2 shows an external view of an embodiment of extension attachment shoe, rotation gear, rotation gear bearing, rotation gear teeth, and tension and activation component in an embodiment of the present invention.

FIG. 1 shows the internal components of the staple device 9 and FIG. 2 shows the external components of staple device 9. The internal components of the device comprises: (1) a staple anvil 2 that slidably drives staples 6 into the surface 17; (2) an anvil spring 1 to provide slidable driving energy for the staple anvil 2; (3) an anvil actuator arm 3 that rotates about rotation axle 4 to raise and release the staple anvil 2 and compress the anvil spring 1; (4) staple holder 5, a staple sled 16, and a staple tension spring 7 that pushes against the staple sled 16 to deliver staples 6 to the staple anvil 2; and (5) staples 6 to be driven into the surface 17 by the staple anvil 2.

The external components of the shown in FIG. 2 comprises: (1) tension and activation component 14 fixed externally to the staple device 9 to hold and tension the wired lights 19, against the surface 17 and to activate the stapling process, and a rack gear 13 fixed to the tension and activation component 14; (2) the rotation gear 10, which is rotatably attached to rotation gear bearing 11, and has rotation gear teeth 12 to transfer the liner motion of the tension and activation component 14 into rotational motion to rotate the internal anvil actuator arm 3; and (3) the extension rod shoe 8 to attach the extension rod 18 to the staple device 9.

Figure 3:
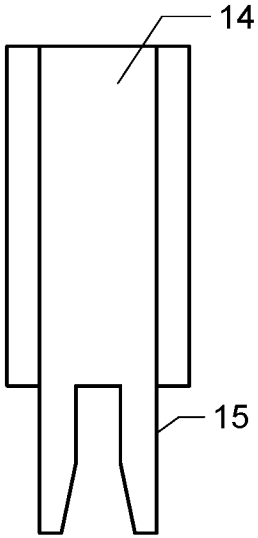
FIG. 3 shows a front view of an embodiment of the tension and activation component with the v-shaped groove in an embodiment of the present invention.
Figure 4:
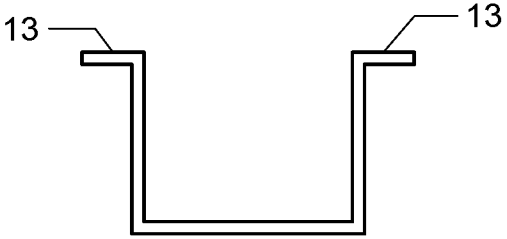
FIG. 4 shows a top view of an embodiment of a tension and activation component in an embodiment of the present invention.

FIG. 3 and FIG. 4 show the front and top view of the tension and activation component 14. The tension and activation component 14 utilizes a groove 15 that is elongated and V-shaped in the front face to allow the wired lights 19 to slide through but does not allow the light bulb portion to pass through (see FIGS. 6B and 6C). This allows the installer to hook the wired lights 19 into the groove 15 and pull them tight from a previous staple 6, or from gravity for an initial staple 6, before stapling into the surface 17. A rack gear 13 fixed to that engages with rotation gear teeth 12 of rotational gear 10. A lever/handle of a normal staple gun uses a squeezing motion to drive a staple. In apposition to this, the staple device 9 due to the mechanism of the rack gear 13 and rotational gear 10 with its rotation gear teeth 12 accomplishes stapling with a linear or pushing motion.

Figure 5:
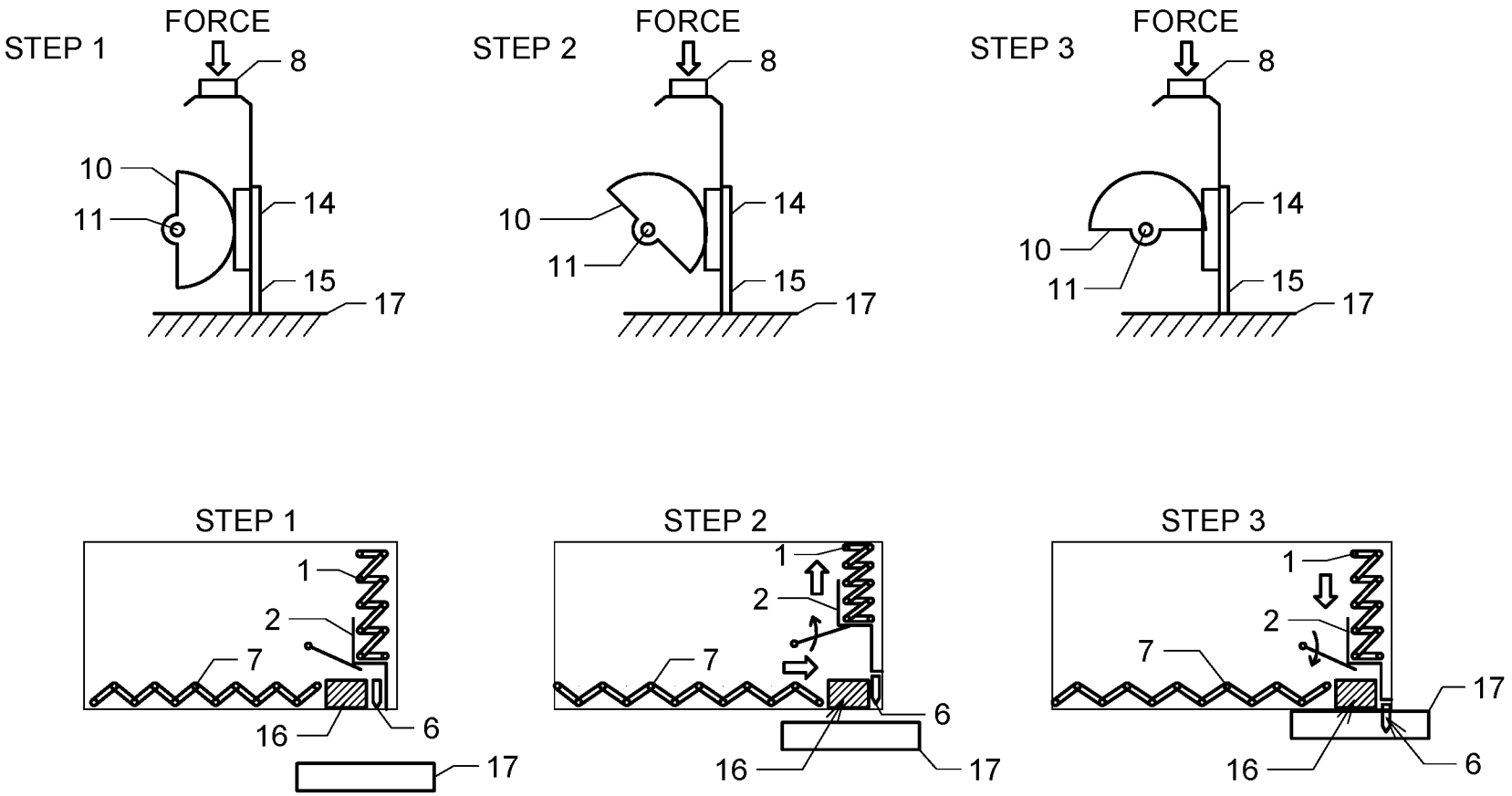
FIG. 5 shows internal and external activation steps, starting on the left and finishing on the right, when the device is pressed into a surface in an embodiment of the present invention.

FIG. 5 shows how the staple device 9 functions, in three steps. The internal and external views of the three steps are show together. For the staple device 9 to work, the installer would hold the extension rod 18 to secure a first portion of the wired lights 19 within the groove 15 of the staple device 9 (as described in the paragraph above) and raise the staple device 9 to the surface 17. After making contact with the surface 17 the installer 20 would push the staple device 9 toward the surface 17 with the extension rod 18 (not shown in FIG. 5) to embed a staple 6 into the surface 17 and thereby securing the first portion of the wired lights 19 to the surface 17. One or more bulbs may be skipped and the groove 15 engages a next portion of the wired lights 19. After again making contact with the surface 17 the installer 20 would push the staple device 9 into the surface 17 with the extension rod 18 (not shown in FIG. 5) to embed a next staple 6 into the surface 17 and thereby securing the next portion of the wired lights 19 to the This process is repeated until all of the wired lights 19 are secured to the surface 17.

Step 1 shows the tension and activation component 14 making contact with the surface 17. Notice the tension and activation component 14 is in the fully extended position, the rotation gear 10 is at the start location, and anvil activation arm 3 and the staple anvil 2 are in the start position as well.

In step 2 the installer pushes the extension rod 18 further towards the surface 17. This causes the tension and activation component 14 to retract, which rotates the rotational gear 10. The rotation gear 10 with rotation gear teeth 12 engaging with rack gear 13 causes the anvil activation arm 3 to rotate about rotation axle 4 and starts to raise the staple anvil 2 and compress the anvil spring 1. As the staple anvil 2 raises the staple tension spring 7 pushes a staple 6 under the staple anvil 2.

In Step 3 the installer continues to push the extension rod 18 further towards the surface 17. This continues the actions of step 2 until the anvil activation arm 3 rotates around rotation axle 4 completely and the staple anvil 2 slips off the anvil activation arm 3. Once this occurs, the stored energy in the now fully compressed anvil spring 1 drives the staple anvil 2 down onto the top of the staple 6 and drives the staple 6 out the bottom of the staple device 9, over a portion of the wired lights 19 and into the surface 17. As the staple device 9 is then moved away from the surface 17 the system will reset and is ready for another full operational cycle. The reset is accomplished with a torsion spring (not shown) on the rotation axle 4, or, alternatively, with a coil spring (not shown) attached to the anvil activator arm 3. Either of those two components will create a force pulling the anvil activator arm 3 back down to its starting point.

Figure 6B:
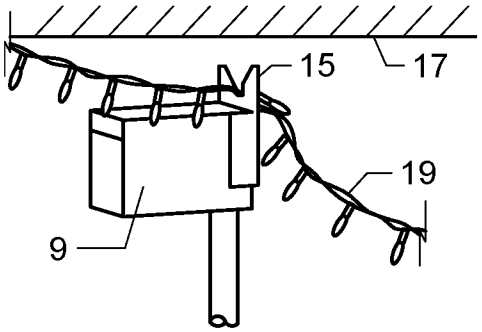
FIGS. 6A, 6B, and 6C show diagrams of an embodiment of the use of the present invention to install wired lights to the eaves or soffits of a dwelling.
Figure 6C:
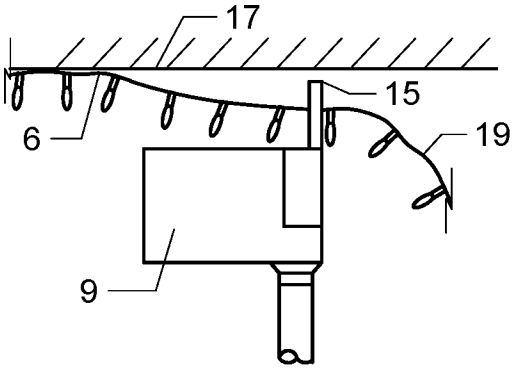
Figure 6A:
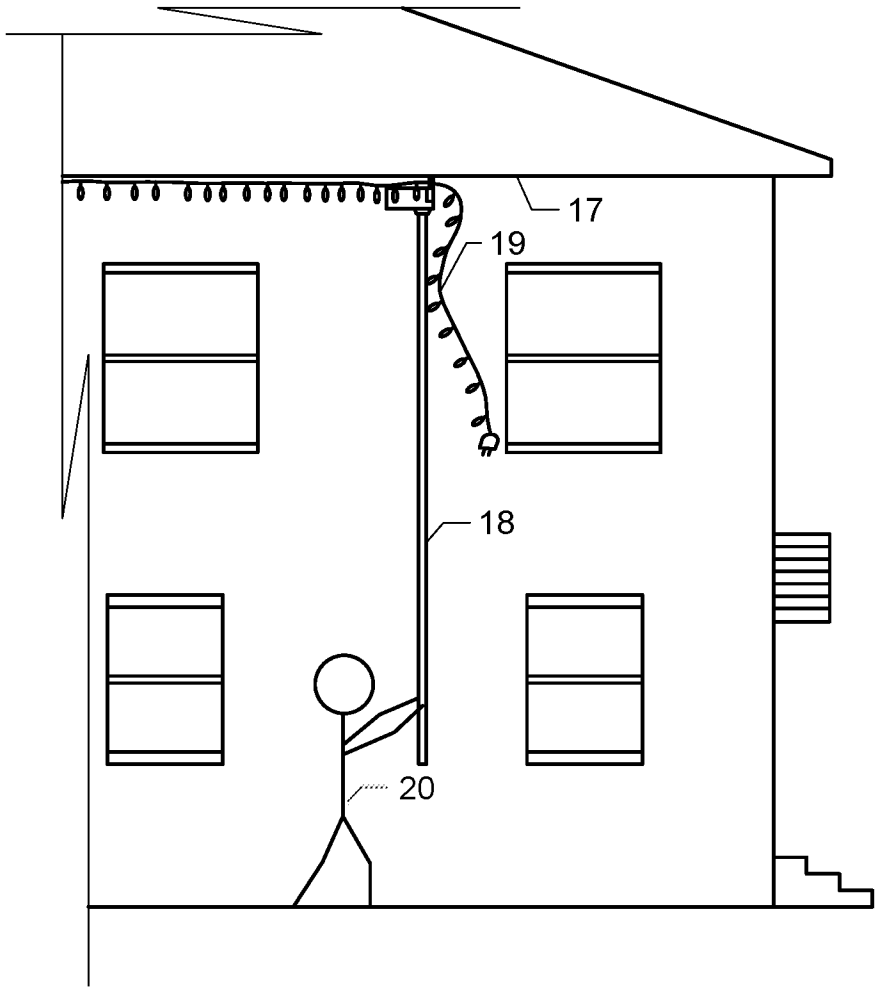

FIGS. 6A, 6B, and 6C show how an installer 20 would operate the staple device 9 from the ground to staple wired lights 19 to a surface 17. FIGS. 6B and 6C show the operation of the tension and activation component 14 with a string of wired lights 19.

Having described the present invention, it will be understood by those skilled in the art that many and widely differing embodiments and applications of the invention will suggest themselves without departing from the scope of the present invention.

What is claimed is:

1. An apparatus for installing a wired lights to a surface, the apparatus comprising:

a staple device, the staple device further comprising;

a plurality of staples contained within the staple device;

a staple anvil slidably located within the staple device; and a tension and activation component fixed externally to the staple device to hold and tension at least one wired lights against a surface;

an extension rod attached to the staple device that applies force that drives each of the plurality of staples into the surface;

a rotation gear fixed externally to the staple device and rotatably attached to a rotation gear bearing and having a rotation gear teeth; and a rack gear fixed to the tension and activation component that engages with the rotation gear teeth to transfer the liner motion of the tension and activation component into rotational motion to rotate the anvil actuator arm.

2. The apparatus for installing wired lights to a surface according to claim 1 wherein the staple device further comprises:

an anvil spring located within the staple device; and an anvil actuator arm located within the staple device that rotates about a rotation axle, and raises and releases the staple anvil against the anvil spring.

3. The apparatus for installing wired lights to a surface according to claim 1 wherein the staple device further comprises:

staple holder located within the staple device;

a staple sled located within the staple holder; and a staple tension spring that pushes against the staple sled to deliver the plurality of staples to the staple anvil.

4. The apparatus for installing wired lights to a surface according to claim 1 wherein the staple device further comprises:

an extension rod shoe for attaching the extension rod to the staple device.

5. The apparatus for installing wired lights to a surface according to claim 1 wherein the tension and activation component further comprises:

a groove that is elongated and V-shaped to allow the at least one wired lights to slide through but does not allow a light bulb portion to pass through.

6. A method for installing a wired lights to a surface, the method comprising the steps of:

(a) engaging a first portion of a wired lights with a staple device;

(a1) securing the first portion of the wired lights within a groove of a tension and activation component of the staple device, (b) raising the staple device to a surface via an extension rod fixed to the staple device;

(c) pushing the staple device toward the surface with the extension rod;

(c1) retracting the tension and activation component; rotating a rotational gear having rotation gear teeth engaged with a rack gear of the tension and activation component; and (d) embedding a staple into the surface, securing the first portion of the wired lights to the surface via the staple.

7. The method according to claim 6, wherein step (c1) further comprises the step of:

retracting the tension and activation component;

rotating an anvil activation arm; raising a staple anvil; 8 compressing an anvil spring; and pushing a staple under the staple anvil.

8. The method according to claim 7 wherein step (d) further comprises the step of:

rotating the anvil activation arm until it slips off of the staple anvil; and driving by the anvil spring the staple anvil against the staple and into the surface.

9. The method according to claim 6 further comprising the step of:

(e) repeating steps (a) through (d) for a next portion of the wired lights.

10. The method according to claim 9 further comprising the step of:

repeating step (e) until the entirety of the wired lights are secured to the surface.

11. An apparatus for installing a wired lights to a surface, the apparatus comprising:

a staple device, the staple device further comprising;

a mechanism that uses a pushing motion to drive a staple into a surface; and a tension and activation externally to the staple device to hold and tension at least one wired lights against the surface;

an extension rod attached to the staple device that applies a force for the pushing motion that drives the staple into the surface;

a rotation gear fixed externally to the staple device and rotatably attached to a rotation gear bearing and having a rotation gear teeth; and a rack gear fixed to the tension and activation component that engages with the rotation gear teeth to transfer the liner motion of the tension and activation component into rotational motion to rotate the anvil actuator arm.

12. The apparatus for installing wired lights to a surface according to claim 11 wherein the staple device further comprises:

a plurality of staples contained within the staple device;

a staple anvil slidably located within the staple device;

an anvil spring located within the staple device; and an anvil actuator arm located within the staple device that rotates about a rotation axle, and raises and releases the staple anvil against the anvil spring.

13. The apparatus for installing wired lights to a surface according to claim 12 wherein the staple device further comprises:

staple holder located within the staple device;

a staple sled located within the staple holder; and a staple tension spring that pushes against the staple sled to deliver the plurality of staples to the staple anvil.

14. The apparatus for installing wired lights to a surface according to claim 11 wherein the staple device further comprises:

an extension rod shoe for attaching the extension rod to the staple device.

15. The apparatus for installing wired lights to a surface according to claim 11 wherein the tension and activation component further comprises:

a groove that is elongated and V-shaped to allow the at least one wired lights to slide through but does not allow a light bulb portion to pass through.

* * * * *